US006976548B2

(12) United States Patent
Neville et al.

(10) Patent No.: US 6,976,548 B2
(45) Date of Patent: Dec. 20, 2005

(54) SELF RELIEVING SEAL

(75) Inventors: James L. Neville, Conroe, TX (US); James L. Larsen, Spring, TX (US); Steven W. Peterson, The Woodlands, TX (US); Manikiran Bandi, Pearland, TX (US); Alan Lockstedt, Houston, TX (US); Peter T. Cariveau, Houston, TX (US); Alysia C. White, Fulshear, TX (US); Anthony Griffo, The Woodlands, TX (US); Michael Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/406,065

(22) Filed: Apr. 2, 2003

(65) Prior Publication Data

US 2004/0040747 A1 Mar. 4, 2004

Related U.S. Application Data

(60) Provisional application No. 60/369,497, filed on Apr. 3, 2002.

(51) Int. Cl.[7] ..... E21B 10/22

(52) U.S. Cl. ..... 175/371; 175/359; 277/926; 277/928

(58) Field of Search ..... 175/359, 371; 277/926, 928, 927

(56) References Cited

U.S. PATENT DOCUMENTS

| | | | | |
|---|---|---|---|---|
| 2,760,793 A | * | 8/1956 | Beak | 277/401 |
| 2,807,483 A | * | 9/1957 | Cornelius | 277/561 |
| 3,531,132 A | * | 9/1970 | Lissau | 277/436 |
| 3,942,805 A | * | 3/1976 | Sundqvist | 277/431 |
| 4,337,956 A | * | 7/1982 | Hopper | 277/552 |
| 4,384,724 A | * | 5/1983 | Derman | 277/431 |
| 4,440,423 A | * | 4/1984 | Pfeifler, II | 285/25 |
| 4,457,517 A | * | 7/1984 | Dunegan | 277/608 |
| 4,981,182 A | | 1/1991 | Dysart | |

(Continued)

FOREIGN PATENT DOCUMENTS

EP 0267140 5/1988

*Primary Examiner*—Frank S. Tsay
*Assistant Examiner*—Giovanna M. Collins
(74) *Attorney, Agent, or Firm*—Jeffer, Mangels, Butler & Marmaro LLP

(57) ABSTRACT

Self relieving seals of this invention comprise an elastomeric seal body having a first sealing surface and a second sealing surface for contact with respective drill bit sealing surfaces. The seal includes a pair of external surfaces that each extend along the seal body between the first and second sealing surfaces. The seal includes one or more relief ports that are disposed through the seal body and that have openings through each of the seal body external surfaces. The relief port can be specially configured, e.g., have different diameter sections of constant or variable dimensions, to provide a degree of control over pressure equalization through the seal body when the seal is loaded within the drill bit. The seal may include an element, e.g., solid, tubular, or porous, disposed within the relief port to provide a further desired degree of control over pressure equalization through the seal when the seal is loaded within the drill bit. Surface features, on the seal or the drill bit, can be provided to offset the relief port opening from the rock bit so that it is not blocked off. The seal can include a valve mechanism to provide a further degree of control over fluid passage through the relief port.

56 Claims, 10 Drawing Sheets

U.S. PATENT DOCUMENTS 5,076,589 A * 12/1991 Marsi ..... 277/394
5,513,711 A * 5/1996 Williams ..... 175/57
6,343,796 B1 * 2/2002 Lee et al. ..... 277/605
6,467,547 B2 * 10/2002 Maguire et al. ..... 166/386
6,578,647 B2 6/2003 Page et al.
6,615,926 B2 * 9/2003 Hester et al. ..... 166/370

* cited by examiner

SELF RELIEVING SEAL

RELATION TO COPENDING PATENT APPLICATION

This patent application claims priority of U.S. Provisional Patent Application No. 60/369,497, filed on Apr. 3, 2002.

FIELD OF THE INVENTION

The present invention relates generally to sealed bearing earth boring drill bits, such as rotary cone rock bits. More particularly, the invention relates to drill bits having one or more seals disposed therein for protecting internal bearing elements. Yet more particularly, the present invention relates to a seal construction that enables pressure communication between the interior and exterior environments of earth boring drill bits.

BACKGROUND OF THE INVENTION

During earthen drilling operations using sealed bearing drill bits, such as rotary cone drill bits, it is necessary to protect the bearing elements of the bit from contamination in order to sustain bit operability. In particular, it is desirable to isolate and protect the bearing elements of the bit, such as bearings, bearing lubricant and bearing surfaces that are located in a bearing cavity or cavities between each corresponding bit leg and roller cone, from earthen cuttings, mud and other debris in the drilling environment. The introduction of such contaminants into the bearing system of the drill bit can lead to deterioration of the bearing lubricant, bearings and bearing surfaces, resulting in premature bit failure. An annular seal is, therefore, placed in the bit between the external environment and the bearing to prevent such unwanted contaminants from entering the drill bit through the annular opening and into a gap formed between each leg and corresponding roller cone that extends to the bearing cavity.

In a downhole drilling environment, the borehole contains "drilling fluid," which can be drilling mud, other liquids, air, other gases, or a mixture or combination thereof. In a typical liquid drilling environment of a petroleum well, the downhole fluid pressure at the location of the drill bit, i.e., the "external pressure," can be very high and fluctuating. At the same time, internal pressure within the bearing cavity, i.e., the "internal pressure," can also be very high and fluctuating due, for example, to thermal expansion and out-gassing of lubricant in the bearing cavity, and to cone movement relative to the leg. These high pressure changes internal and external to the bearing cavity may cause a differential pressure across the annular seal, thus resulting in a major unchecked load on the seal.

When the internal pressure is greater than the external pressure, the seal may be drawn to and possibly extruded into the gap. Likewise, a greater external pressure can cause the seal to be drawn in the direction of the bearing cavity and possibly extruded therein. This may cause excessive wear to or tearing of the seal, which can eventually lead to bit inoperability. Furthermore, when the pressure differential between the bit internal and external environments reaches a certain level in each above scenario, the seal can leak, allowing lubricant to pass from the bearing cavity into the gap in the first scenario, and drilling fluid to pass from the gap into the bearing cavity in the second scenario.

Generally, when the internal pressure and the external pressure are equal, the differential pressure across the bearing cavity seal will be zero. There will be no pressure to force the drilling fluid or lubricant by the seal, or to force the seal into the gap or bearing cavity. Thus, it is generally desirable to achieve or maintain a differential pressure of approximately zero across the bit during operation. Drill bits are, therefore, constructed having a lubricant reservoir system disposed therein to equalize the internal and external pressure across the seal. Such lubricant reservoir systems typically have a flexible diaphragm located in a lubricant reservoir cavity placed in the bit leg. The flexible diaphragm operates to separate the internal lubricant from the external drilling fluid and communicates the external pressure to the portion of the bearing seal adjacent the bearing cavity. This type of pressure compensation system for a single seal bit is schematically shown in FIG. 1A.

Referring to FIG. 1A, when the external or borehole pressure Pd of the drilling fluid in the borehole $B_1$ increases and is greater than the internal pressure Pg in the bearing cavity, the seal $S_1$ will be forced inwardly toward the bearing cavity $B_2$. With the use of a flexible diaphragm $D_1$, the external pressure Pd is also applied to the diaphragm $D_1$, which transmits the pressure Pd, equalizing it with the internal pressure Pg. As a result, the pressure on both sides of the seal $S_1$ is balanced, preventing the occurrence of any differential pressure across the seal $S_1$. Similarly, when the pressure Pg increases, Pg will temporarily be larger than Pd, causing the diaphragm $D_1$ to expand outwardly to increase the internal volume of the bearing cavity $B_2$. As the internal volume increases, the internal pressure Pg will decrease. Pg will drop to equilibrium with Pd, and the internal volume will stop increasing.

Dual seal arrangements have been proposed having an outer seal positioned within a seal gland located between the external environment and a primary inner seal. The purpose of including a second seal is typically to provide a second layer or barrier of protection from particles entering the gap through the annular opening. When an outer seal is added, it may be necessary, such as in drill bits used for petroleum wells, that the bit be capable of compensating for the differential pressure across both seals. FIG. 1B shows a dual-seal bit schematic with both seals providing substantially absolute seals. The "space" Sp formed between the seals $S_1$, $S_2$ is completely filled with an incompressible fluid, and there is no variation in the density of the incompressible fluid.

In this scenario, the incompressible fluid in space $S_p$ between the seals $S_1$ and $S_2$ transmits pressure from $Pg_1$, which is the (internal) bearing cavity pressure, to Pd and from Pd to $Pg_1$. For example, when the external fluid pressure Pd increases, the diaphragm $D_1$ will be pushed inwardly, causing the internal pressure $Pg_1$ to equal the external pressure Pd. Because the fluid between seals $S_1$ and $S_2$ is incompressible, it will transmit the increased pressure between $S_1$ and $S_2$, and neither seal $S_1$ nor $S_2$ will be displaced.

However, during borehole drilling operations, such as with rotary cone sealed bearing drill bits, various factors will alter ideal conditions and require something more to equalize the differential pressure across both seals $S_1$ and $S_2$. For example, there can be a relative movement between the roller cone and bit leg, which causes the volume of the space $S_p$ between the seals $S_1$ and $S_2$ to significantly increase and decrease. A change in the volume of the space $S_p$ will change the chamber pressure $Pg_2$ in the space $S_p$, causing conditions where $Pg_2>Pd$, $Pg_1$ upon contraction of the space $S_p$, and where $Pg_2<Pd$, $Pg_1$ upon expansion of the space Sp. Thus, there can be differential pressures across both seals $S_1$, $S_2$, causing their movement and possible extrusion, which can cause accelerated seal wear and eventual bit failure.

Another potential factor altering ideal conditions is the thermal expansion, or out-gassing, of the incompressible fluid between the seals $S_1$, $S_2$ due to elevated temperatures within the bit. Referring to FIG. 1B, expansion of the incompressible fluid in the space Sp between the seals $S_1$, $S_2$ will elevate the chamber pressure $Pg_2$. Increasing the chamber pressure $Pg_2$ can cause a differential pressure across the seals $S_1$, $S_2$ such that $Pg_2$>Pd, $Pg_1$, which can result in accelerated wear and possible extrusion of seals $S_1$, $S_2$.

Still another factor is the existence of air trapped in the space Sp between the seals $S_1$, $S_2$. In this instance, the mixture of air and fluid in space Sp is not incompressible. When external pressure Pd increases, $Pg_1$ will eventually equal Pd due to the diaphragm $D_1$, but Pd>$Pg_2$ and $Pg_1$>$Pg_2$ because of the presence of air in the space Sp between the seals $S_1$, $S_2$. The chamber pressure $Pg_2$ in the space Sp will not increase until the seals $S_1$, $S_2$ move closer together and the air volume in space Sp decreases. This differential pressure across seals $S_1$, $S_2$ will cause the movement and possible extrusion of the seals into the space Sp and excessive wear on the seals.

U.S. Pat. No. 5,441,120, which is hereby incorporated by reference herein in its entirety, discloses the use of an additional flexible diaphragm $D_2$, such as that shown in FIG. 1C, to attempt to equalize, or balance the chamber pressure $Pg_2$ of the space Sp with the external pressure Pd or internal pressure $Pg_1$. Further increases in external pressure Pd will thereafter be transmitted through the fluid in the space Sp. Such a system has various disadvantages. For example, this system requires or occupies much space within the bit leg, structurally weakening the bit, and limiting the size of bits that can incorporate such system. Also, this system does not allow for pressure relief from the space Sp, such as caused by thermal expansion and outgassing of the incompressible fluid between the seals $S_1$, $S_2$, which can cause damage to the seals as described above.

U.S. Pat. Nos. 4,981,182 and 5,027,911, which are also hereby incorporated herein in their entireties, disclose various embodiments of drill bits having inner and outer seals where the lubricant is bled out of the bit past the outer seal to prevent drilling debris from accumulating and damaging the inner and outer seals. In some such embodiments, passages in the bit allow lubricant to travel from the bearing cavity to the space between the seals. In other embodiments, a hydrodynamic inner seal is used, which allows the leakage of lubricant from the bearing cavity to the space between the seals. In both instances, the pressure of the lubricant presumably forces the outer seal to open and allow the bleeding of lubricant from the bit.

These systems also have various disadvantages. For example, the continuous bleeding of lubricant past the outer seal (particularly if the outer seal fails) can lead to the depletion of bearing lubricant in the bit, and cause bearing and bit damage due to a lack of lubricant. For another example, if the space between the seals in such configurations is not filled with lubricant, which will occur if there is a decrease or stoppage in the flow of lubricant from the bearing cavity to the space, a high pressure differential across the seals can result, causing damage to the seals as described above. For yet another example, with many such embodiments, because the space between the seals and the bearing cavity are in fluid communication, there exists the possibility that debris or drilling fluid bypassing the outer seal, such as when the outer seal fails, will move through the space between the seals and into the bearing cavity, causing contamination and damage to therein and to the bearing elements.

Therefore, there remains a need for improved techniques and mechanisms for substantially balancing or minimizing the pressure differential imposed upon either a single seal within a drill bit, or upon primary and secondary seals of a dual-seal configuration, particularly by allowing pressure communication and for equalization between the interior and exterior of the drill bit. Ideally, the devices and techniques will accommodate cone movement, thermal expansion of the fluid and/or out-gassing between the primary and secondary seals, and trapped air in the space between the seals. It is also desired that such pressure communication devices that do not require substantial additional components, large space requirements in the bit, or highly complex manufacturing requirements.

Also well received would be a pressure communication technique and device capable of preventing the pressure differential across the dual seals from exceeding an upper limit, such as, for example, 100 psi. It would also be advantageous to include the use of an incompressible fluid having the capabilities of retaining sufficient viscosity to act as a medium for the transmission of energy between the primary and secondary seals, of retaining its lubrication properties, and/or of slowing the intrusion of abrasive particles to the primary seal when and after the incompressible fluid is exposed to drilling fluid.

SUMMARY OF THE INVENTION

Self relieving seals, constructed according to the practice of this invention, are useful for providing a desired degree of pressure communication within a single seal or multiple seal rotary cone drill bit. Seals of this invention comprise an elastomeric seal body having a first sealing surface and a second sealing surface for contact with respective drill bit sealing surfaces. The seal includes a pair of external surfaces that each extend along the seal body between the first and second sealing surfaces. A key feature of self relieving seals of this invention is that they include one or more relief ports that are disposed through the seal body and that have openings through each of the seal body external surfaces.

In an example embodiment, the first sealing surface is positioned along an outside diameter of the seal body, the second sealing surface is position along an inside diameter of the seal body, and the relief ports are disposed axially through the seal body and comprise openings in the seal body external surfaces that are each positioned facing axially outwardly from the seal body.

Self relieving seals of this invention may have a relief port that is specially configured to provide a degree of control over pressure equalization through the seal body when the seal is loaded within the drill bit. In one example, the relief port may be characterized by different diameter sections and/or by sections having constant and variable diameters. In other examples, the seal may include an element, e.g., a solid element, a tubular element, or a porous element, disposed within the relief port to provide a further desired degree of control over pressure equalization through the seal when the seal is loaded within the drill bit.

Additionally, seal of this invention may include a surface feature along one or both of the body external surfaces that is configured to maintain a desired offset between the relief port opening and an adjacent rock bit surface to not block off the opening when the seal is loaded in the drill bit. Alternatively, the rock bit may itself have a wall surface that is configured to provide a desired offset between itself and the seal external surface to ensure that the seal relief port opening is not blocked off.

Self relieving seals of this invention may also include a valve means disposed in fluid or gas flow communication with the relief port fort the purpose of providing further control over the equalization of pressure therethrough. In one example, the valve means can be in the form of a check valve that is designed to permit one-way checked flow through the relief port, e.g., to permit the passage of grease through the port when internal pressure within the drill bit exceeds the external drill bit pressures, but to prevent the unwanted passage of drilling fluid from the drill bit external environment into the drill bit.

Self relieving seals configured in this matter operate to equalize pressure differentials that may exist within a drill bit during operation by the control passage of fluid or gas therethrough. The ability to provide such pressure equalization function helps to avoid any unwanted pressure forces acting on the seal. If left unchecked, such pressure forces could operate to urge the seal outside of its provided seal cavity, which could cause the seal to become damaged and no longer able to provide a desired sealing function, e.g., either allowing lubricant to pass from the drill bit journal bearing, allowing drilling fluid to pass into the drill bit to the journal bearing or both. Accordingly, seal relieving seals of this invention operate to minimize or eliminate such unwanted pressure affects, thereby operating to extend the useful service life of a drill bit.

BRIEF DESCRIPTION OF THE DRAWINGS

These and other features and advantages of the present invention will become appreciated as the same becomes better understood with reference to the drawings wherein.

DETAILED DESCRIPTION

Annular seals of this invention are useful, for example, in subterranean drill bits, and generally comprise one or more relief ports or passages disposed through an axial width of the seal body to facilitate passage and relief of otherwise unrelieved built up pressure that may occur with the drill bit, and more specifically, built up pressure that may occur between seals in a dual-seal drill bit.

Figure 1A:
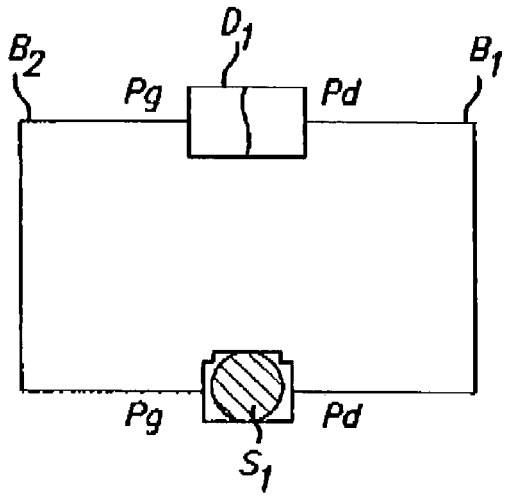
FIG. 1a PRIOR ART
FIG. 1A is a schematic diagram of a prior art single seal drill bit pressure compensation system.
Figure 1B:
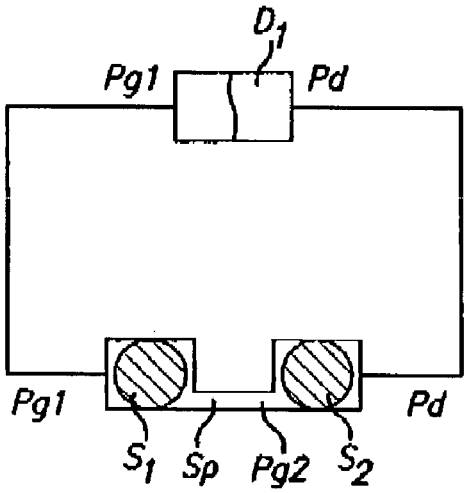
FIG. 1b PRIOR ART
FIG. 1B is a schematic diagram of a prior art dual-seal drill bit pressure compensation system.
Figure 1C:
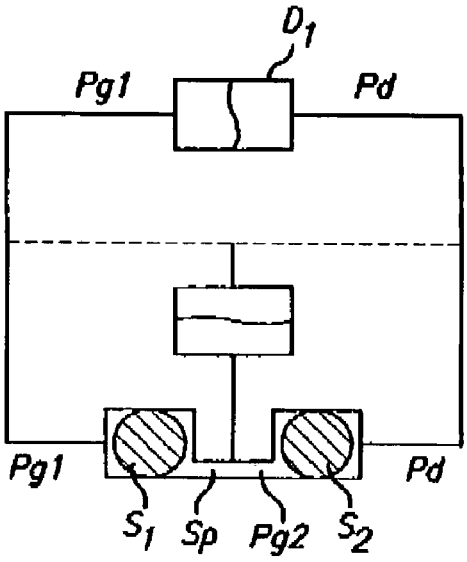
FIG. 1c PRIOR ART
FIG. 1C is a schematic diagram of another prior art dual-seal drill bit pressure compensation system.
Figure 2:
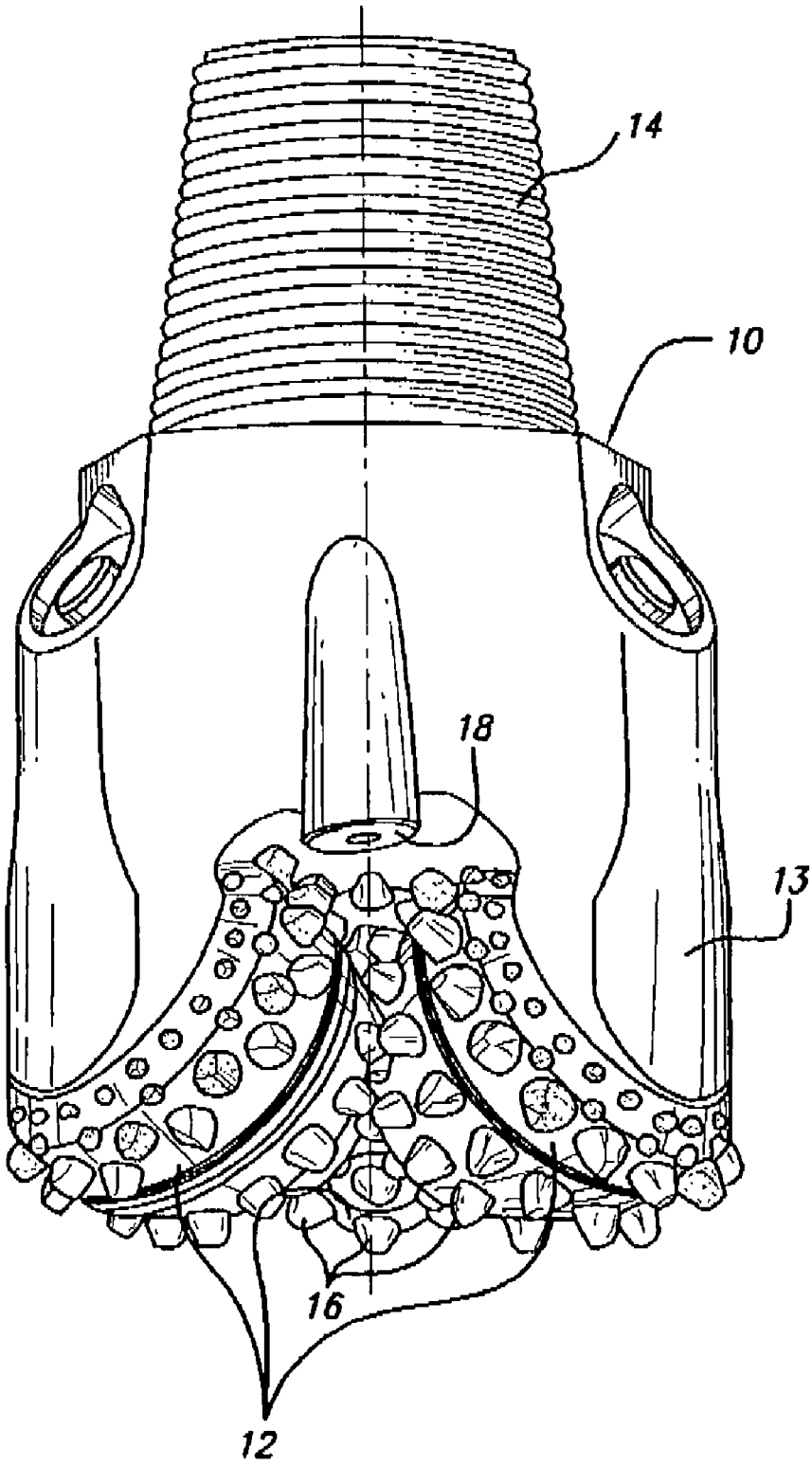
FIG. 2 is a semi-schematic perspective of a bit containing an annular seal constructed according to the principles of this invention.

Referring to FIG. 2, drill bits, e.g., rock bits, employing an annular ring seal constructed according to principles of this invention generally comprise a body 10 having three cutter cones 12 each rotatably mounted on respective leg portions 13 of the body lower end. A threaded pin 14 is positioned at the upper end of the body 10 for assembly of the bit onto a drill string for drilling oil wells or the like. A plurality of inserts 16 are pressed into holes in the surfaces of the cutter cones for bearing on the rock formation being drilled. Nozzles 18 in the bit body introduce drilling fluid into the space around the cutter cones for cooling and carrying away formation chips drilled by the bit.

Annular journal seals, in the form of a ring seal, are generally thought of as comprising a cylindrical inside and outside diameter, and a circular radial cross section. However, it is to be understood that annular seals constructed in accordance with the principles of this invention may be configured as having either a circular or symmetric cross section (e.g., in the form of an O-ring seal), or as having a high-aspect ratio or asymmetric cross section.

Figure 3:
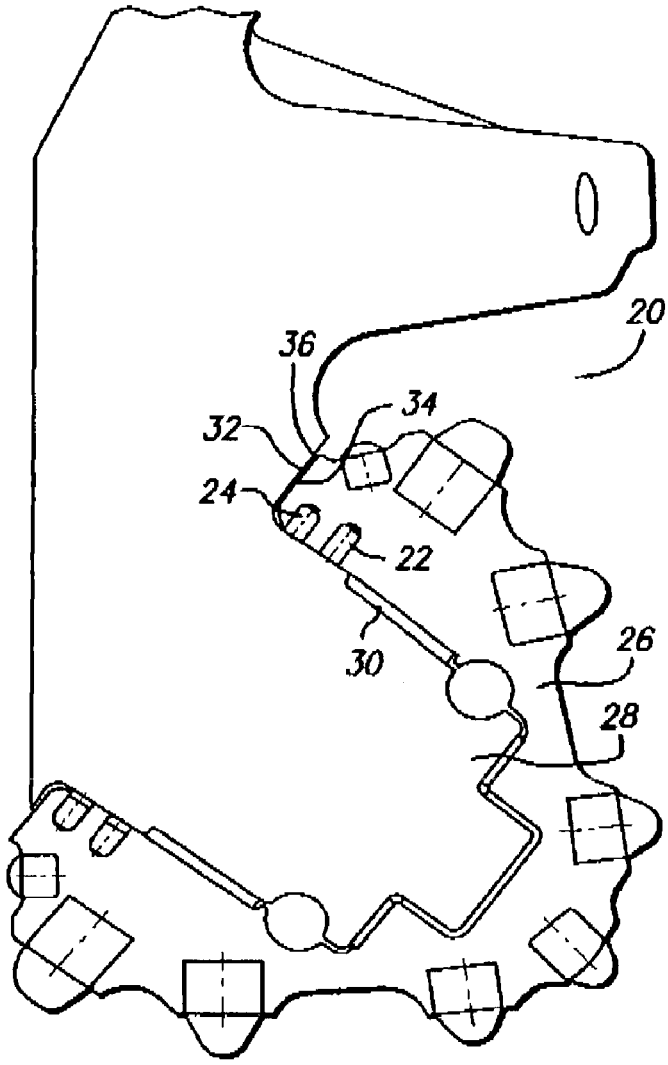
FIG. 3 is a partial cross-sectional side view of a dual-seal bit comprising an annular seal constructed according to the principles of this invention.

FIG. 3 illustrates an example bit 20 constructed having two annular seals 22 and 24, that is thereby referred to as a "dual-seal" bit. The annular seals in such dual-seal bit can be positioned differently within the bit depending on the size, packaging, and application of the bit. For purposes of illustration and reference, the dual-seal bit presented in FIG. 3 illustrates but one example of how the seals can be positioned within the bit. In this particular example, the seals 22 and 24 are positioned side-by-side of one another in respective seal glands or cavities that are formed between the bit cone 26 and leg 28, and are positioned within the bit to each provide radial sealing, i.e., sealing along a radially-oriented annular seal surface.

While such an example has been illustrated, it is to be understood that annular seals of this invention can be configured to provide other than radially-oriented sealing, e.g., to provide sealing along an axially-oriented seal surface, or to provide sealing along a portion of the seal surface positioned between a radial and axial surface (such as along a canted sealing surface). Additionally, seals of this invention are intended to be used in bits where both of the seals provide a sealing function along a similar sealing surface, e.g., along the radial, axial, or canted surfaces of each seal, and in bits where both of the seals provide a sealing function along a different sealing surface, e.g., where one seal provides a seal along one of an axial, radial or canted surface of the seal, and the other seal provides a seal along another of an axial, radial or canted surface of the other seal.

Additionally, while annular seals of this invention have been illustrated for use with a dual-seal bit, annular seals of this invention are also intended to be used in drill bits comprising a single seal, whether such single seal bit includes or does not include a conventional pressure compensating reservoir. In such single seal bit applications, annular seals of this invention are used for the purposes of equalizing the pressure differential that may exist on opposite sides of the seal. Thereby, reducing and/or eliminating the potential for seal damage caused by such unchecked pressure forces.

Referring still to FIG. 3, in a dual-seal bit, the annular seal 22 is referred to as a first or primary annular seal that is positioned adjacent a bit bearing 30 for purposes of maintaining lubricant or grease between the bearing surfaces. The annular seal 24 is referred to as a secondary annular seal and is positioned adjacent the end 32 of the cone 26 to minimize or prevent the ingress of drilling debris between the cone and leg surfaces and axially inwardly toward the primary seal 22. A gap 32 exists between the adjacent cone and leg faces 34 and 36.

Dual-seal bits come in many different sizes, depending on the particular application. Some of the larger dual-seal bits are configured having a pressure compensation subassembly (not shown) disposed therein for purposes of addressing unwanted pressure build up within the bit during operation. In a typical dual-seal bit, the pressure compensation subassembly is in communication with the journal bearing via a port extending thereto through the leg. Configured in this manner, only one side of the primary seal 22 is exposed to the pressure compensation subassembly. Thus, any built up pressure on the opposite side of the primary seal 22, e.g., built up pressure between the primary and secondary seal, has no way of being relieved. Such uncontrolled pressure effects within the bit can cause one or both of the seals to be damaged, e.g., by extrusion.

Internal pressures within rock bits are caused by the elevated temperatures that occur within a bit during operation as well as the elevated temperature of the down hole environment. In some deep hole drilling applications, internal rock bit temperatures can go as high as 300° F. and beyond. During any drilling operation there are also external pressures acting on the rock bit that can be higher than 10,000 psi. This pressure is equalized within a bit by the pressure compensation subassembly, so that the annular seal has equivalent pressure acting on both the mud side (i.e., the side of the annular seal positioned adjacent the bit external environment) and the bearing side (i.e., the side of the annular seal positioned adjacent the bit bearing) of the seal. This pressure equalization is important for purposes of maintaining proper seal positioning within the seal gland in the bit.

Any unchecked differential pressure can exert an undesired pressure force on the seal in an axial direction within the seal gland. The direction that the seal is urged depends on whether the bit external or internal pressure is controlling, which will depend on the particular bit design, drilling application and operating conditions. In situations where the bit external pressure is controlling, the annular seal will be forced inwardly within the seal gland in an axial direction towards the bearing 30. In situations where the bit internal pressure is controlling, the annular seal will be forced outwardly within the seal gland in an axial direction towards the gap 32 and the bit external environment.

In a dual-seal bit, such as that illustrated in FIG. 3, a pressure build up is known to occur between the two seals, thereby exerting an oppositely directed pressure force on both of the seals. Such pressure force operates to urge the seals away from one another in their respective seal cavities. This internal pressure force can act to urge the primary annular seal 22 within its seal gland towards the bearing 30, and can act to urge the secondary annular seal 24 within its seal gland towards the gap 32 between the leg and cone. In each case, if the internal pressure is great enough, a sidewall portion of each seal adjacent the leg sealing surface can be urged and extruded into a clearance or groove extending from each respective seal gland that is formed between the cone and leg.

In an effort to minimize and/or eliminate the above-described damage to bit annular seals, annular seals of this invention have been specifically constructed to include one or more relief ports, that are disposed axially through a width of the seal body. It is additionally important that the annular seal be resistant to crude gasoline and other chemical compositions found within oil wells, have a high heat and abrasion resistance, have low rubbing friction, and not be readily deformed under the pressure and temperature conditions in a well which could allow leakage of the grease from within the bit or drilling mud into the bit.

Seal constructions of this invention comprise a seal body that is formed from an elastomeric material selected from the group of carboxylated elastomers such as carboxylated nitrites, highly saturated nitrile (HSN) elastomers, nitrile-butadiene rubber (HBR), highly saturated nitrile-butadiene rubber (HNBR) and the like. Particularly preferred elastomeric materials are HNBR and HSN. An exemplary HNBR material is set forth in the examples below. Other desirable elastomeric materials include those HSN materials disclosed in U.S. Pat. No. 5,323,863, that is incorporated herein by reference, and a proprietary HSN manufactured by Smith International, Inc., under the product name HSN-8A. It is to be understood that the HNBR material set forth in the example, and the HSN materials described above, are only examples of elastomeric materials useful for making annular according to this invention, and that other elastomeric materials made from different chemical compounds and/or different amounts of such chemical compounds may also be used.

It is desired that such elastomeric materials have a modulus of elasticity at 100 percent elongation of from about 400 to 2,000 psi (3 to 12 megapascals), a minimum tensile strength of from about 1,000 to 7,000 psi (6 to 42 megapascals), elongation of from 100 to 500 percent, die C tear strength of at least 100 lb/in. (1.8 kilogram/millimeter), durometer hardness Shore A in the range of from about 60 to 95, and a compression set after 70 hours at 100° C. of less than about 18 percent, and preferably less than about 16 percent.

An exemplary elastomeric composition may comprise per 100 parts by weight of elastomer (e.g., HSN, HNBR and the like), carbon black in the range of from 20 to 50 parts by weight, peroxide curing agent in the range of from 7 to 10 parts by weight, zinc oxide or magnesium oxide in the range of from 4 to 7 parts by weight, stearic acid in the range of from 0.5 to 2 parts by weight, and plasticizer up to about 10 parts by weight.

Figure 4:
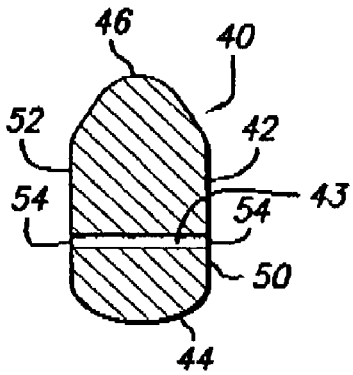
FIG. 4 is a cross-sectional side view of an annular seal constructed according to principles of this invention.

Generally speaking, annular seals of this invention are constructed having one or more relief or breathing ports disposed through an axial width of the seal body. FIG. 4 illustrates a first embodiment example annular seal 40 of this invention comprising a seal body 42 that is formed from one of the elastomeric materials described above. The seal body comprises a first sealing surface 44 at one seal body end, and a second sealing surface 46 at an opposite seal end. In an example embodiment, the seal first sealing surface may be positioned on the seal body to provide a seal with a dynamic rotary bit surface, and may for that reason be referred to as a dynamic sealing surface. The seal second sealing surface may be positioned on the seal body to provide a seal with a relatively static bit surface, and my for that reason be referred to as a static sealing surface. This particular seal body has an asymmetric shape, relative to an axis passing though an axial width of the body, in that the second sealing surface 46 is defined by a radius of curvature that is less than that of the first sealing surface 44. However, it is to be understood that annular seals of this invention may be configured in a number of different ways, e.g., having a symmetric or an asymmetric shape.

A key feature of the annular seal 40 is that it have a relief port 48 passing through an axial width of the seal body defined by seal walls 50 and 52. The port 48 extends through the seal body to openings 54 positioned at each seal wall 50 and 52. In this particular example embodiment, the port 48 is constructed having a constant diameter. The relief port 48 can be manufactured directly by molding it into the seal body during the molding process. The relief port may also be made laser drilling, as well as by other drilling methods. A hot needle or other element capable of making a hole by puncture method can also be used to make the relief port.

Figure 5:
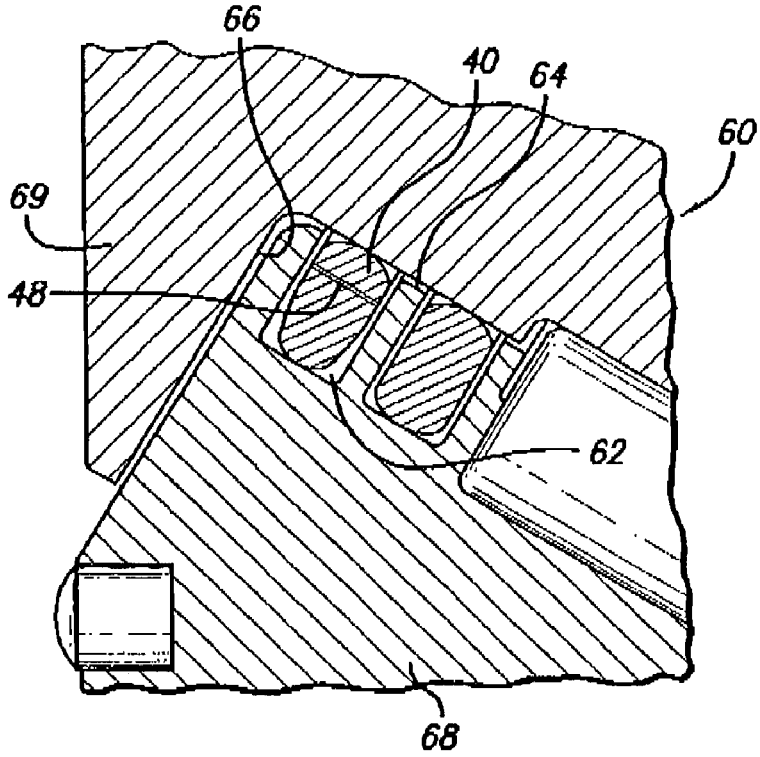
FIG. 5 is a partial cross-sectional side view of a dual-seal bit comprising the annular seal of FIG. 4.

FIG. 5 illustrates use of the annular seal 40 of FIG. 4 as the secondary seal in a dual-seal drill bit 60. When placed within a seal gland 62, the annual seal is subject to a radially directed compression loading force that causes the relief port 48 to be partially or completely squeezed closed. As a pressure differential is built up on opposed sides of the seal, the relief port 48 operates to facilitate pressure passage in either direction to achieve pressure equalization. The pressure build up can be in the space 64 between the two seals. In which case the relief port in the annular seal 40 functions to permit passage of grease through the seal body, to the gap 66 between the cone 68 and leg 69, and equalize with the pressure external to the drill bit. Alternatively, the pressure build up can be external to the bit. In which case the relief port in the annular seal functions to permit passage of drilling mud through the seal body and into the seal gland 62.

It is, therefore, important that the relief port 48 be sufficiently sized to permit a desired degree of pressure passage when loaded into the drill bit in response to a certain differential pressure. For example, the relief port can be sized to operate in the manner of a check valve, i.e., to permit the passage of pressure through the seal body after a determined pressure build up or pressure differential across the seal is achieved.

Figure 6:
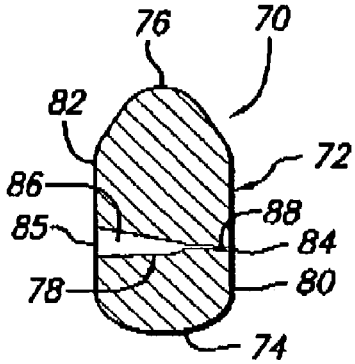
FIG. 6 is a cross-sectional side view of an annular seal constructed according to principles of this invention.

FIG. 6 illustrates another example embodiment annular seal 70 of this invention comprising an elastomeric seal body 72 having a first sealing surface 74 at one seal body end, and a second sealing surface 76 at an opposite seal end. Like the example annular seal embodiment described above and illustrated in FIGS. 4 and 5, this seal embodiment also has a relief port 78 passing through an axial width of the seal body defined by seal walls 80 and 82. The port 78 extends through the seal body to openings 84 and 85 positioned at each respective seal wall 80 and 82.

In this particular example embodiment, the port 78 is constructed having two distinct diameter sections; namely, a first section 86 that has a noncontinuous diameter, e.g., in a preferred embodiment it has a tapered diameter, and a second section 88 that has a constant diameter. The first section 86 of the relief port extends from the opening 85 positioned within seal wall 82, and has a decreasing diameter moving inwardly through the seal body. The second section 88 extends within the relief port from an end of the first section 86 to the opening 84 positioned within seal wall 84, and is characterized by a constant diameter.

The first section 86 can be shaped and sized to ensure that this portion of the relief port remains open when the seal is loaded into the drill bit. The second section 88 is defined by a web of the seal body having a thickness that extends from the seal wall 80 to the inner end of the first section 86. In an example embodiment, the second section 88 of the relief port is formed by using a sharp instrument or the like to pierce the web.

The seal can be designed to provide a desired fluid transfer characteristic by controlling such parameters as the modulus of the material used to form the seal body, the size and shape of the relief port first diameter section, the thickness of the web, and the diameter of the relief port second diameter section. Generally speaking, the thicker the web the higher the relief pressure needed to pass fluid through the relief port for a fixed relief port second diameter section.

Figure 7:
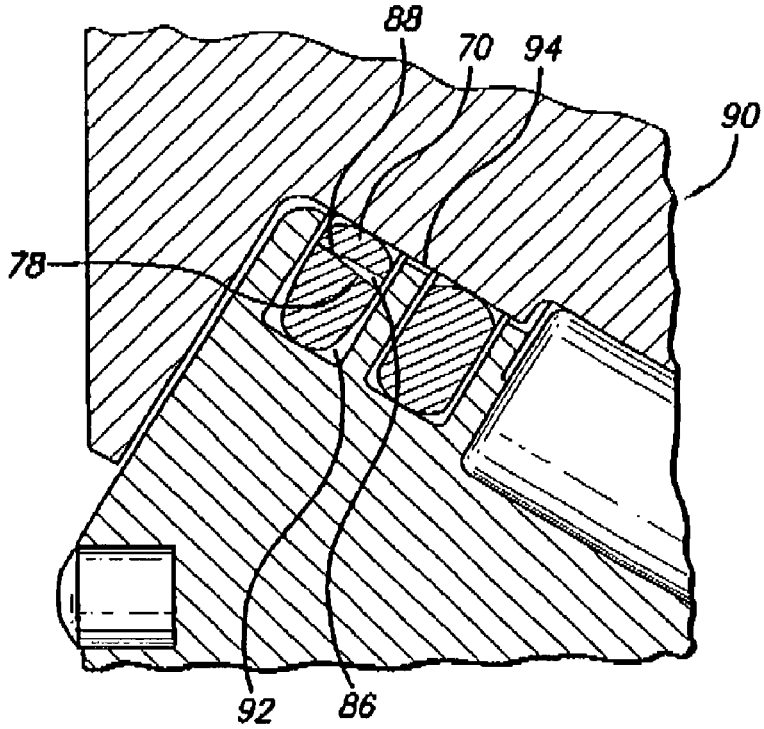
FIG. 7 is a partial cross-sectional side view of a dual-seal bit comprising the annular seal of FIG. 6.

FIG. 7 illustrates use of the annular seal 70 of FIG. 6 as the secondary seal in a dual-seal drill bit 90. When placed within a seal gland 92, the annual seal is subject to a radially directed compression loading force that causes the relief port 78 to be squeezed and reduced in diameter. When the annular seal 70 is squeezed (i.e., energized between the cone and leg), the second diameter section 88 of the relief port 78 is squeezed and/or closed shut, while the first section 86 of the relief port remains open. As pressure within the drill bit space 94 between the seals builds up, it is allowed to escape and equalize with the pressure on the other side of the seal via the relief port 78 by the following method. Fluid first enters the relief port first diameter section 86 where it is allowed to build until it is sufficient to cause the relief port second diameter to open, thereby effecting passage of the fluid through the seal. Placement of the relief port first diameter section adjacent space 94 operates to facilitate pressure passage through the seal 70 by operating to urge the relief port second diameter section open when a certain pressure is achieved. In this annular seal embodiment, the second diameter section 86 of the relief port is normally closed, to prevent unwanted passage of drilling mud into the bit from the outside environment, but opens when a desired relief pressure is built up within the bit.

Again, as mentioned above for the earlier seal embodiment, it is important that both sections of the relief port be sized and configured to permit a desired fluid or gas flow characteristic therethrough when the seal is loaded into the drill bit. The size and configuration of the relief port determines the relief pressure of the seal. If the relief port is sized too small and/or configured improperly, a large amount of pressure will be allowed to build up before being relieved which can lead to seal damage. If the relief port is sized too big and/or configured improperly, the amount of pressure relief will be too low, allowing the incompressible fluid between the seals (in a dual-seal bit) to escape and/or allow drilling mud into the space between the seals.

With this understanding, it is believed that the relief port be designed to relieve between 0 and 100 psi, and preferably around 50 to 70 psi. Many factors affect the relief pressure, of which those known are as follows: the axial seal body width, the seal body modulus, the diameter of the relief port second diameter section, the web thickness, the size and configuration of the relief port first diameter section, the thermal expansion of the seal, the overall seal geometry, and the amount of squeeze or deflection of the seal when it is installed in the drill bit between the cone and leg.

Methods for forming the relief port for annular seals of this invention have been described above. Alternatively, the relief port in annular seals of this invention can be formed by piercing the seal body with a needle or like instrument, whereas little or no material is removed from the seal body, and the relief port closes up upon removal of the needle. Forming the relief port by this method would result in a higher relief pressure being required to relieve pressure through a mechanism of this type. In an effort to address this issue, means could be inserted into the relief port for keeping the passage open. Such means can be in the form of a thread, cord, or any other material that is capable of being passed through the seal body relief port to maintain the relief port in an open condition, thereby providing an easier path for the pressure to transmit though the seal.

In an effort to ensure unimpaired passage of fluid or gas through annular seals of this invention, it may be desired to provide a surface feature adjacent one or both relief port openings that operates to prevent blockage of such opening (s) when loaded in the bit. Such surface feature can be positioned on a wall portion of the seal gland and/or on a wall portion of the seal itself.

Figure 8A:
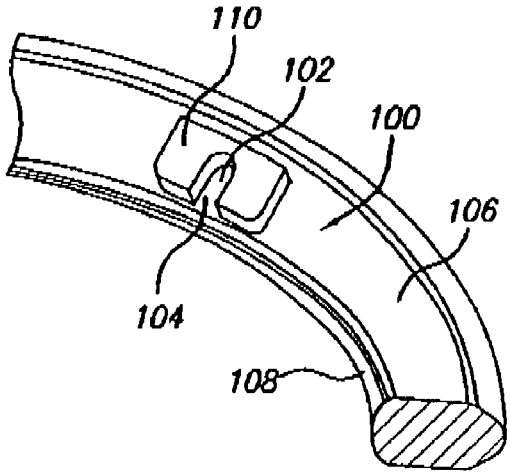
FIG. 8A is a partial perspective view of an annular seal of this invention comprising a modified surface feature.
Figure 8B:
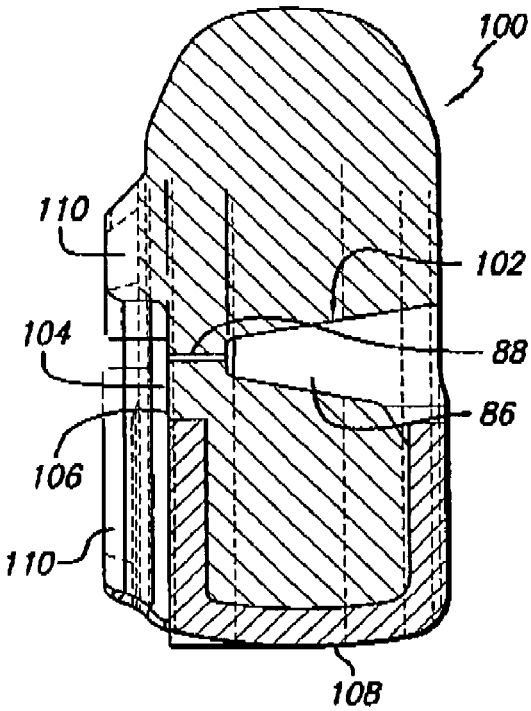
FIG. 8B is a cross-sectional side view of the annular seal of FIG. 8A.

FIGS. 8A and 8B illustrates a section of an annular seal 100 of this invention comprising a relief port 102 disposed therethrough, configured in the manner described above, i.e., comprising a first diameter section 86 and a second diameter section 88. The second diameter section 88 could also be provided by a pierced hole that removes no material. The seal 100 additionally comprises a channel 104 that is located along axial seal wall 106, and that extends radially therealong from an opening of the relief port 102 to the seal body dynamic seal surface 108. The channel 104 is formed by a raised surface feature 110 of the seal wall 106, e.g., a platform, that projects outwardly a desired distance from the seal wall. The raised surface feature 110 operates to offset the opening of the relief port 102 from the axial seal wall surface so as to prevent direct placement of the opening against a seal gland wall, thereby operating to prevent an unwanted relief port opening blockage.

Figure 8C:
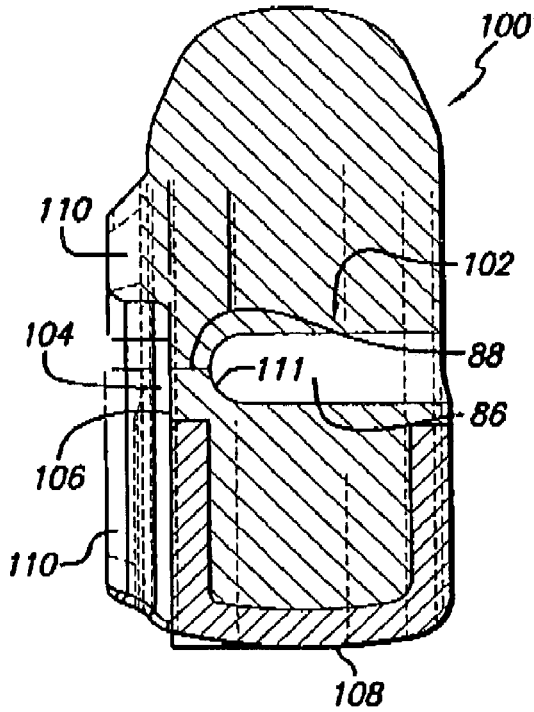
FIG. 8C is a cross-sectional side view of an alternative annular seal configuration to that illustrated in FIG. 8B.

FIG. 8C illustrates an annular seal of this invention that is similar to that illustrated in FIG. 8B, except for the fact that the relief port first diameter section 86 is characterized by having a substantially constant diameter opening that is larger than the second diameter section. In this example embodiment, the relief port first diameter section 86 comprises a constant diameter that is sized so that it does not collapse when the seal is loaded and placed into operation within the bit. Additionally, the first diameter section 86 includes an end 111 inside of the relief port that is characterized as providing a radiused transition to the relief port second diameter section. The feature having a radiused relief port first diameter section end 111 is believed to improve the strength of the seal body web, defining the relief port second diameter section, in a manner that does not impact relief pressure.

It is to be understood that the means described above for protecting the seal relief port opening from blockage is but one structural embodiment of how this can be achieved, and that many other types of surface feature modifications can be provided to achieve the same goal. Thus, any and all surface feature modifications to the seal body that would result in preventing one or both of the relief port openings from being blocked when loaded into a drill bit are intended to be within the scope of this invention.

Figure 9:
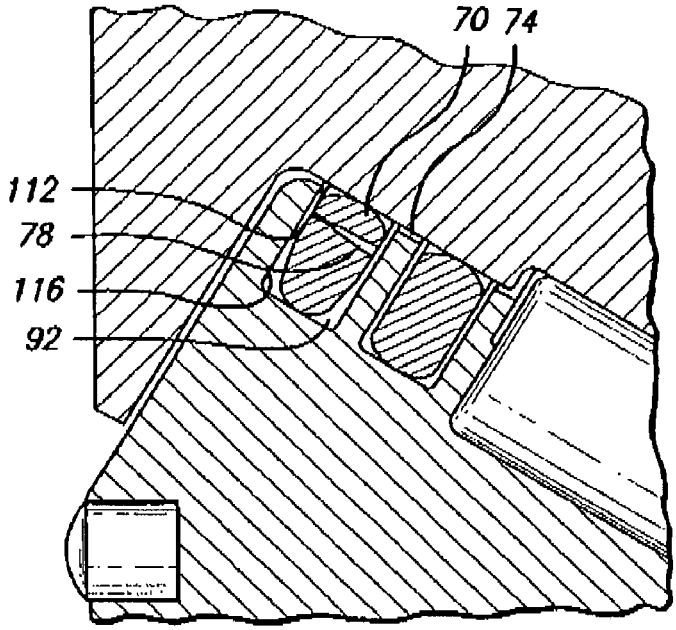
FIG. 9 is a partial cross-sectional side view of a dual-seal bit comprising the annular seal of FIG. 6 and having a modified seal gland surface feature.

Alternatively, the means for preventing blocking of the relief port opening can be constructed as part of the seal gland in addition to/or in place of any modifications to the seal itself. FIG. 9 illustrates the annular seal embodiment 70 of FIG. 6 as a secondary seal disposed within a drill bit having a seal gland 92 that is specially configured to prevent seal relief port opening blockage. Specifically, the seal gland 92 is constructed having an outwardly projecting surface feature 112, e.g., in the form of a rib and a channel, that operates to prevent an adjacent opening 114 of the relief port 78 from abutting an adjacent wall surface 116 of the seal gland, which can restrict the flow of fluid (grease, air, etc.) out of the seal gap space 74. The channel disposed in the seal gland wall surface operates to provide a conduit or flow path for fluid to flow out of the seal gland 92, thereby operating to facilitate the desired pressure relief.

Although annular seals of this invention were illustrated in FIGS. 4 to 8A as being formed from a single type of material, it is to be understood that (depending on the particular seal application) annular seals of this invention can have a composite construction, i.e., can comprise one or more portion formed from a material that is different than that used to form the seal body. For example, FIG. 8B illustrates an embodiment of the annular seal of this invention that is formed from more than one type of material. In this particular embodiment, the dynamic sealing surface 108 is formed from a material that is different from that used to form the seal body.

Thus, it is to be understood that annular seals of this invention may comprise a seal body having first and second sealing surfaces formed from materials that are the same as or different from that used to form the seal body. For example, annular seals of this invention may comprise one or both sealing surfaces (e.g., a dynamic sealing surface) formed from an elastomeric material that is relatively harder than that used to form the seal body, as recited in U.S. Pat. No. 5,842,701, which is incorporated herein by reference. Annular seals of this invention may also comprise one or both sealing surfaces (e.g., a dynamic sealing surface) formed from a composite material in the form of an elastomer/fiber fabric, as recited in U.S. Pat. No. 5,842,700, which is also incorporated herein by reference. Thus, it is to be understood within the scope of this invention that annular seals of this invention may comprise a composite of more than one type of material.

As used herein, the term dynamic is used to describe a sealing surface of the seal that is placed into rotary contact with a drill bit surface, and the term static is used to describe a sealing surface of the seal that is placed into a principally static contact with a drill bit surface. The static sealing surface is qualified by the term principally because in drill bit operation it is known that the static sealing surface can go dynamic under certain operating circumstances, i.e., the static sealing surface can move relative to the contacting drill bit.

Figure 10A:
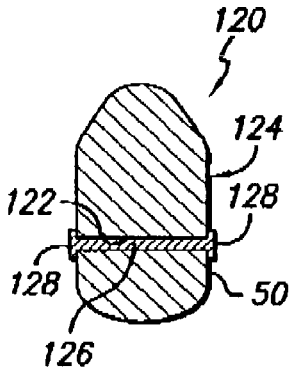
FIG. 10A is a cross-sectional side view of an annular seal constructed according to principles of this invention comprising a member disposed with a relief port.

FIG. 10A illustrates another embodiment annular seal 120 of this invention that is similar to that disclosed and illustrated above in that it includes a relief port 122 disposed through an axial width of the seal body 124. Additionally, this particular seal embodiment includes an element 126 that is positioned within the relief port. The element can be in the form of a flexible member, e.g., a cord or wick, or a non-flexible rigid member, e.g., a metal or plastic pin, having an outside diameter that is less than the relief port diameter.

In this seal embodiment the element 126 serves to keep the relief port opened, to resist the relief port from being completely collapsed when the seal is squeezed during operation, thereby operating to maintain the open passage of fluid therethrough for pressure equalizing purposes. In an example embodiment, the element 126 is freely disposed within the relief port and is not bonded or otherwise attached therein. Also, the element 126 is sized and shaped to provide a defined annular passageway within the relief port to yield a desired fluid or gas flow characteristic through the seal. For example, when the element is sized having a smaller diameter relative to the relief port, fluid or gas flow through the annular passageway will be relatively unrestricted. When the element is sized having a larger diameter relative to the relief port, fluid or gas flow through the annular passageway will be somewhat restricted to provide a controlled degree of fluid flow.

The element 126 can include end portions 128 at one or both element axial ends for the purpose of retaining the element within the relief port. Additionally, such end portions can be configured to provide a filtering function, e.g., in the form of a porous material or the like, for the purpose of restricting entry into the relief port of unwanted particulate matter above a certain particle size into the port.

Figure 10B:
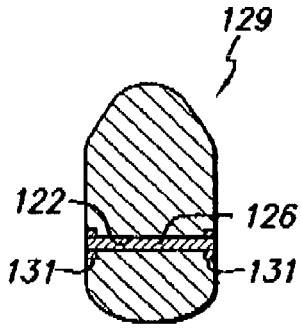
FIG. 10B is a cross-sectional side view of an annular seal constructed according to principles of this invention comprising a member disposed with a relief port.

FIG. 10B illustrates another seal embodiment 129 wherein element 126 disposed within the relief port 122 is formed from a material that itself is capable of itself accommodating fluid transport. In such embodiment, the element 126 can be in the form of a chord or other suitable material capable of serving as a conduit for fluid transport. The element 126 in this application serves two functions; namely, it operates to prevent the complete closure or collapse of the relief port, and it operates as a conduit to facilitate the passage of fluid through the relief port.

This seal embodiment 129 additionally includes an increased surface area feature 131 at each relief port opening that is sized and configured to improve access of the relief port to the seal external environment, thereby serving to minimize or reduce the possibility of the relief port becoming clogged or plugged at or near the port openings. In an example embodiment, the surface feature 131 can be in the form of an enlarged opening area or mouth disposed a desired depth within the external seal body side walls, and in communication with the relief port openings. The enlarged opening serves to increase the surface area exposure of the relief port openings to minimize unwanted plugging. If desired, the enlarged opening area or mouth can additionally be filled with a suitable breathable material, e.g., paper, cloth or the like, to further protect the relief port openings against unwanted clogging.

Figure 11:
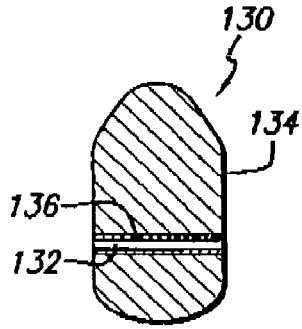
FIG. 11 is a cross-sectional side view of an annular seal constructed according to principles of this invention comprising a non-integral relief port.

FIG. 11 illustrates another embodiment annular seal 130 of this invention that is similar to that disclosed and illustrated above in FIG. 4, in that it includes a relief port 132 disposed through an axial width of the seal body 134. Additionally, this particular seal embodiment includes a tubular element 136 that is positioned concentrically within the relief port 132. In one example embodiment, the tubular element 136 can be formed from a flexible member capable of collapsing on itself when the seal is loaded radially, and that has a low-friction inside diameter surface that resists the tube from bonding to itself. The collapsible tubular element can be formed from low-friction polymer materials selected from the family of polyfluoromeric materials, or can be formed from fabric or woven materials that also display low friction properties.

In such example embodiment, the collapsible tubular element is bonded or otherwise attached along an outside diameter to the inside diameter of the relief port, and is sized having a desired wall thickness to provide a desired collapsing property. Configured in this manner, the tubular element operates as a low-friction seal for the purpose of restricting the passage of fluid therethrough until a desired threshold differential pressure is placed across the seal body. This self sealing characteristic may be desired in certain applications for the purpose of restricting passage of fluid through the seal until a certain pressure differential is achieved.

In another example, the tubular element 132 is a rigid member that can be formed from a suitable structural material, such as metal and the like, resistant to collapsing when the seal is loaded within the bit. The rigid tubular element may or may not be bonded to the seal body. Configured in this manner, the tubular element 132 functions in a reinforcing manner to maintain a desired relief port passage diameter that will not close or be reduced in diameter when the seal is loaded into the bit. In such example embodiment, the tubular element is sized having a particular diameter that will provide the desired fluid flow and pressure transfer characteristics. In still another example, the tubular element 132 can be a rigid member as disclosed above, but include a non-rigid member disposed therein.

Figure 12:
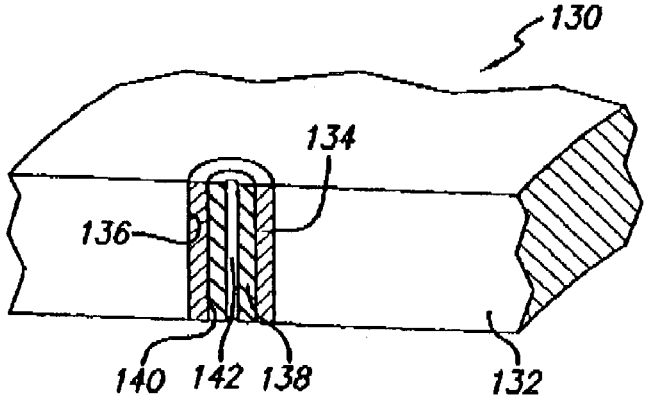
FIG. 12 is a cross-sectional side view of an annular seal constructed according to principles of this invention comprising a non-integral composite relief port.

FIG. 12 illustrates another annular seal embodiment 130 wherein the seal body 132 includes a rigid tubular element 134 positioned within the relief port 136, and further includes a non-rigid tubular member 138 disposed concentrically within an inside diameter 140 of the rigid tubular element 134. The non-rigid tubular member 138 includes a relief port 142 disposed therethrough to facilitate the passage of fluid and pressure relief through the seal body.

In an example embodiment, the non-rigid tubular member 138 can be formed from an elastomeric material, such as rubber or those materials noted above for forming the seal body, and can be bonded to the surrounding rigid tubular member. Ideally, the non-rigid tubular member 138 is formed from an elastomeric material that is capable of providing a desired fluid flow or pressure relieving characteristic.

In this particular embodiment, the combined use of a rigid tubular element and concentrically positioned non-rigid tubular element operates to provide a seal having a relief port 142 that will not be susceptible to collapse when the seal is loaded, yet will have an elastomeric orifice that is capable of functioning, i.e., deflecting, to provide a desired degree of control over the passage of fluid or gas and pressure relief therethrough. For example, in this particular embodiment the non-rigid tubular member 138 is configured having a diameter sized and/or material chosen to provide a desired resistance to fluid flow until a threshold differential pressure is achieved. In this example, the non-rigid tubular member 138 can be formed from an elastomeric material having a lower modulus than that of the seal body, thereby offering a greater level of orifice deflection than otherwise possible in a seal embodiment lacking a surrounding rigid tubular member to protect the same from the squeeze effects of seal loading.

Such annular seal embodiment can be formed by filling a rigid tubular member with an elastomeric material, inserting the rigid tubular member in the seal body relief port, and drilling the elastomeric material disposed within the rigid tubular member to provide a desired relief port diameter.

Although not illustrated in FIGS. 11 and 12, it is to be understood that such annular seal embodiments comprising the tubular element can additionally include a rigid or flexible element disposed within the relief port as discussed above and illustrated in FIG. 10. The rigid or flexible element can be used in such seal embodiments to provide an improved degree of control over fluid or gas passage through the relief port.

Although annular seal embodiments discussed above and illustrated in FIGS. 11 and 12, relating to annular seals comprising a tubular member disposed within the seal body relief port, show the tubular member as extending axially through the complete width of the seal body, it is to be understood that annular seals of this invention can be constructed having a tubular element disposed only partially through the seal body width, e.g., to provide reinforcement to the seal relief port where needed to ensure communication through the seal body. The exact length and placement of the tubular member will depend on many different factors, such as the type of material used to form the seal body, the amount of squeeze the seal body will be subjected to when loaded within the drill bit, and the direction of pressure forces imposed on the seal when the bit is being operated.

There are several areas in the seal that can be reinforced with different materials to ensure that fluid or gas communication be maintained. This is particularly important at high operating temperatures since the rubber seal components become very compliant. The relief port area itself is one of the more critical features since the opening is very small and can be easily closed.

Figure 13:
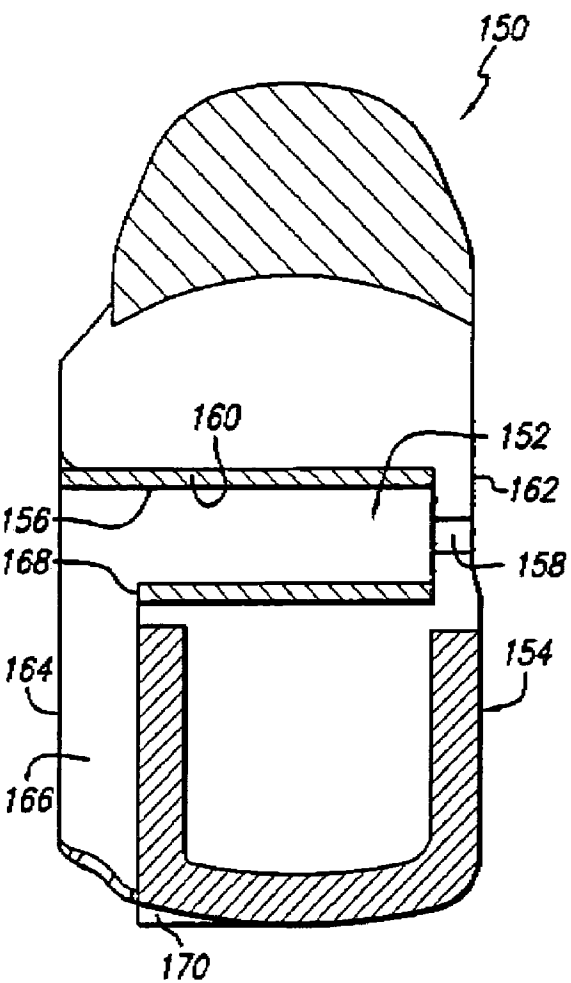
FIG. 13 is a cross-sectional side view of an annular seal constructed according to principles of this invention comprising a partially-reinforced relief port.

FIG. 13 illustrates another example seal embodiment 150 of this invention having a relief port 152 extending axially through a width of the seal body 154, and having a tubular reinforcing member 156 disposed partially within the relief port 152. In this particular example, the seal body relief port comprises two different diameter sections; namely, a first diameter section 158 extending from an internal axial seal body surface 162 that would be positioned adjacent an internal drill bit environment, and a larger second diameter section 160 extending from the first diameter section to an opposite external axial seal body surface 164 that would be positioned adjacent an external drill bit environment.

In this example, the size and length of the relief port first diameter section 158 is selected to provide a minimum amount of compressive force in the region of the first diameter section. This is desired for the purpose of ensuring that the shape and the deflection of the rubber flaps creating the relief port orifice in this region are least affected by pressures and temperatures acting on other parts of the seal body when the bit is being operated. This particular seal design is optimized for releasing internal pressure in the seal gap adjacent the seal surface 162 and also resealing and not allowing unwanted contaminants into the seal gap when external pressures are high. By placing the first diameter section on the internal side of the seal, the internal pressure acts to open the valve with little influence of the surrounding rubber. As the internal pressure increases, forces that act to open the first diameter section also increases.

The reinforcing member 160 operates to isolate areas of the seal though hole so that other forces in the seal cannot influence the pressure relieving operation of the seal as temperatures and pressures deform the seal body. The reinforcing member can be bonded to the surrounding elastomeric seal body relief port and/or can be connected thereto by mechanical or interference fit. One of the highest forces acting on the seal is the sealing force or squeeze imparted on the seal to engage the sealing surfaces. Thermal expansion of the seal itself will increase the seal force as well. This force acts to collapse the relief port used to move grease or gases across the seal body. As a seal wears and/or takes compression set, the seal squeeze is reduced consequently reducing the fluid pressure required to pass through the relief port, possibly to the point where drilling fluid and grease flow freely through the port.

As illustrated in FIG. 13, the seal body includes an external axial surface 164 that includes a channel 166 extending radially therealong from an edge 168 of the reinforcing member 160 to a position adjacent an inside diameter seal surface. The radial channel operates to maintain communication of the seal body relief port with the seal gap adjacent the dill bit external environment even when the seal body is moved against a wall of the seal gland adjacent the external seal body surface 164.

Although the reinforcing member for this example is shown positioned within the seal body adjacent a seal body external axial surface, the reinforcing member can be placed within the relief port so that it is adjacent the seal body internal axial surface. In such an alternative arrangement, the relief port unreinforced portion, i.e., the first diameter section, would be positioned adjacent the seal body external axial surface. Configured in this manner, the first diameter section would additionally function to help keep out unwanted external debris from packing the relief port.

Additionally, although in this illustrated example the first diameter section of the relief port is shown having a relatively short axial length, it is to be understood that the exact diameter and length of the unreinforced relief port section can and will vary depending on such factors as the seal body material, the amount of seal loading or compression force, and the operating temperatures and pressures in the particular drill bit application. For example, in applications where seal body deflection is thought to be minimal during drill bit operation, a sufficient sealing function may be had by increasing the length of the unsupported relief port section beyond that called for by seal applications where the seal body deflection is relatively higher.

Figure 14:
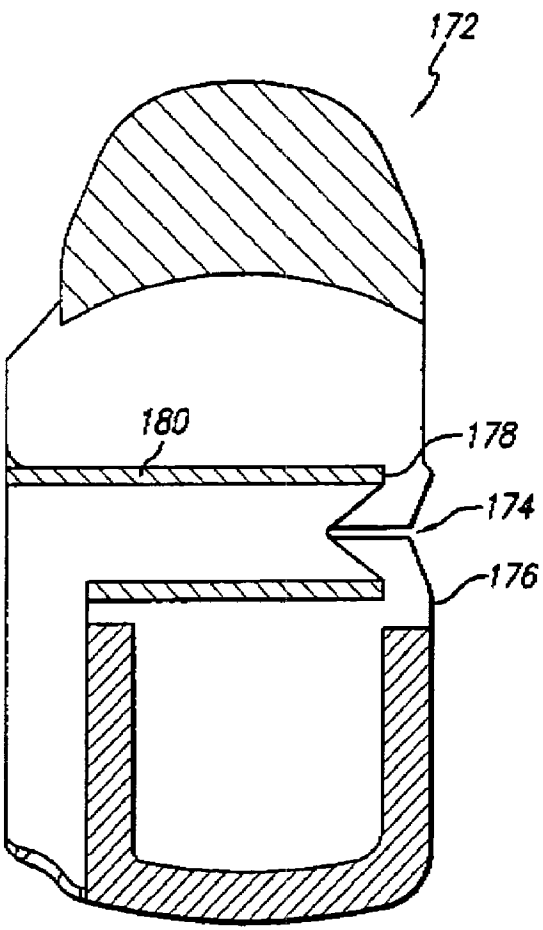
FIG. 14 is a cross-sectional side view of an annular seal constructed according to principles of this invention comprising a modified partially-reinforced relief port.

FIG. 14 illustrates an example seal embodiment 172 that is somewhat similar to that described above and illustrated in FIG. 13, except that it includes a relief port first diameter section 174 that has been modified to include means for controlling or preventing pressure equalization during operating conditions when external pressures act on the seal body. Specifically, the though hole first diameter section 174 is configured from a seal body internal axial surface 176 that is biased axially inwardly a distance into an axial end 178 of the reinforcing member 180. This internal biasing, in conjunction with the size of the relief port first diameter orifice, operates to provide a sort of flapper valve mechanism to permit the one-way passage of fluid or gas through the seal when the internal pressure is greater than the external pressure, and prevent or seal off passage of grease or gas through the seal when the external pressure is greater than the internal pressure.

Figure 15:
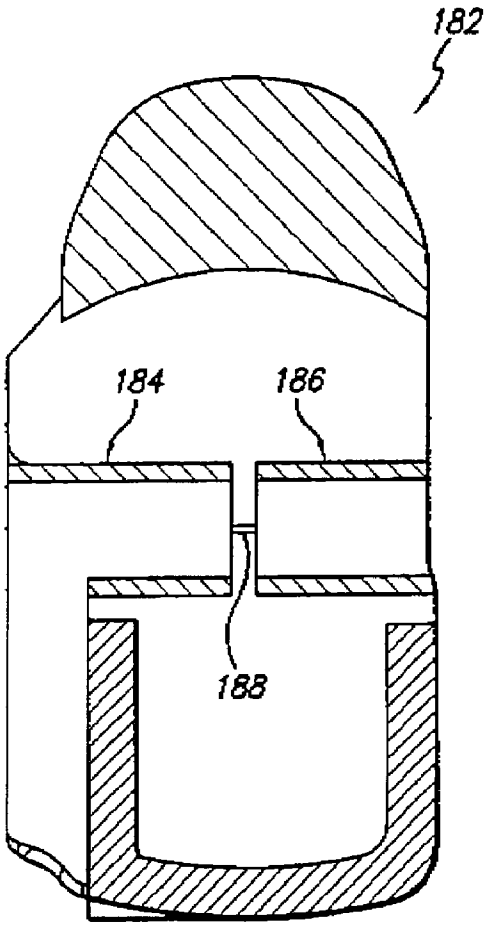
FIG. 15 is a cross-sectional side view of an annular seal constructed according to principles of this invention comprising a modified partially-reinforced relief port.

FIG. 15 illustrates another example seal embodiment 182 that is somewhat similar to that described above and illustrated in FIG. 13, except that it includes two separate reinforced relief port sections, 184 and 186, that each extend axially a defined length from respective external and internal seal body axial surfaces. The reinforced relief port sections are connected via an unreinforced reduced diameter section 186 that has a diameter and length calculated to provide desired fluid or gas flow and/or sealing characteristics within the seal body.

Although not illustrated, it is to be understood that the annular seal embodiments discussed above and illustrated in FIGS. 13 to 15 can additionally comprise a rigid or non-rigid member disposed in the relief port, as illustrated in the seal embodiment of FIG. 10, for the purpose of providing an additional degree of control over the passage of fluid or gas through the seal body.

Figure 16:
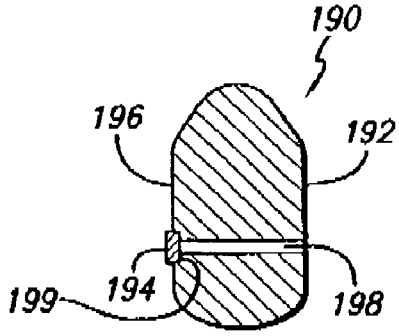
FIG. 16 is a cross-sectional side view of an annular seal constructed according to principles of this invention comprising a porous element in communication with the relief port.

FIG. 16 illustrates another example seal embodiment 190 of this invention that is similar to that disclosed above and illustrated in FIGS. 4, 11 and 12, except that the seal body 192 includes a porous element 194 positioned in communication with the relief port 198. In an example embodiment, the porous element 194 can be positioned adjacent or within the external seal body axial surface 196 and not along the entire length of the relief port. In another example embodiment, the porous element 194 can occupy a substantial portion of the seal body relief port. The porous element 194 can be formed from permeable or porous materials, e.g., fabric material, sponge material, polymeric materials, non-fully densified materials, known to have a desired filtering ability and/or that facilitates the preferential passage of one material over another in response to a desired pressure.

A filtering ability may be desired to control or prevent the entry of certain sized drilling debris particulate matter that may migrate to the seal body and into the relief port. The porous material can be specifically designed to have a defined porosity that will prevent the migration of certain sized particles. It may also be desired that the porous element have the ability to permit the preferential passage of grease from the interior drill bit environment through the relief port, and restrict or control the passage of water from the exterior drill bit environment. In an example embodiment, the porous element can be formed from such a permeable or porous material having one or more pores, and that is specifically constructed to facilitates the preferential of passage of grease therethrough, but restricts the passage of water therethrough until a certain pressure is achieved, e.g., according to the Washburn equation.

The porous element can be used in conjunction with annular seal embodiments having completely reinforced, partially-reinforced, or non-reinforced relief ports. The porous element can be attached to the seal body by bonding or by mechanical attachment technique. In the example embodiment illustrated, the porous element 194 is disposed within a slightly enlarged diameter section 199 of the relief port adjacent the seal body axial exterior surface.

It is desired that the seal body relief port be in constant communication with the drill bit interior and exterior environments during operation of the drill bit for the purpose of maintaining the ability of compensating pressure differentials thereacross. As explained above, differential pressures acting on the seal body can move the seal body axially within the seal gland to cause the axial seal body surfaces to contact adjacent seal gland surfaces. Because such contact cannot be avoided, and because such contact can operate to seal off access to the seal body relief port, it is desired that this issue be addressed. One way of maintaining access to the openings of the seal body relief port was discussed above and illustrated in FIGS. 8A and 8B, and involved providing one or more surface features along an axial surface of the seal body itself adjacent the relief port opening. This concept was also presented in conjunction with the seal embodiments illustrated in FIGS. 13 to 15.

Figure 17:
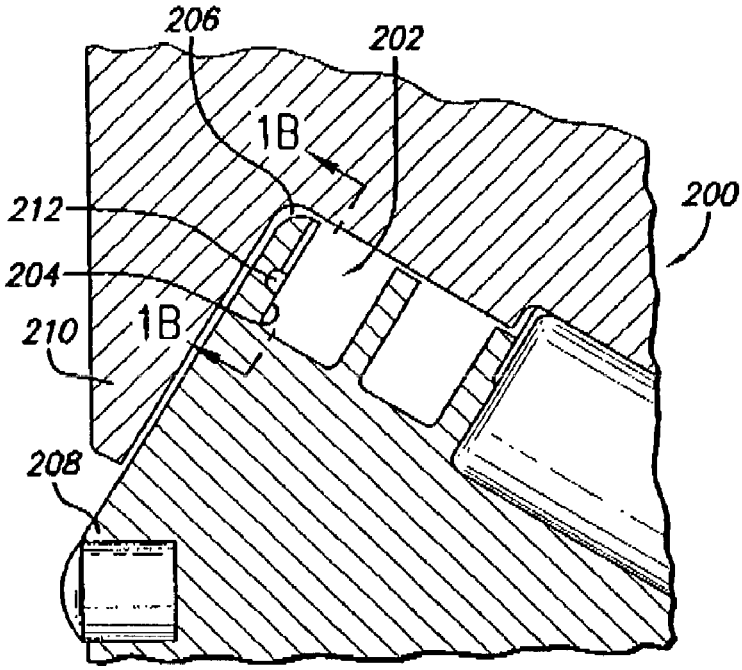
FIG. 17 is a partial cross-sectional side view of a dual-seal bit comprising a modified seal gland wall surface.

However, an alternative way of addressing this issue is to provide the offsetting surface features either as part of the seal gland wall, or as part of a spacer that is interposed between the seal body and the seal gland wall. FIG. 17 illustrates a dual-seal bit journal and cone assembly 200 comprising a secondary seal gland 202 having a exterior wall surface 204 configured to accommodate placement of an annular seal of this invention therein in a manner that maintains communication between the seal relief port and a gap 206 between the cone 208 and journal 210 leading to the external environment.

Figure 18:
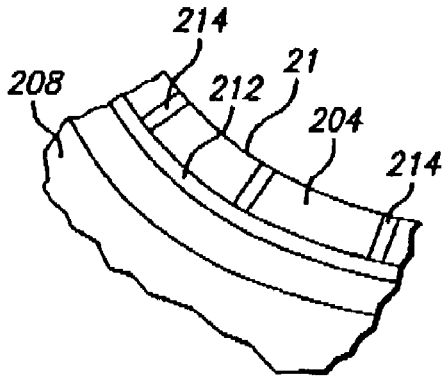
FIG. 18 is a sectional side view of the modified seal gland wall surface of FIG. 17.

More specifically, and referring also to FIG. 18, the seal gland wall surface 204 is configured having a first continuous groove 212 running circumferentially therealong that is positioned so that it corresponds with the location of the seal relief port opening to communicate therewith. The first groove 212 is sized to provide a desired fluid or gas flow characteristic during operation of the drill bit to facilitate passage of fluid or gas to or from the seal gland and annular seal. The seal gland wall surface 204 also includes one or more second grooves 214 that each extend radially from, and that are in communication with, the first groove 212 a distance to an edge 216 of the seal gland.

Configured in this manner, the circumferential groove operates to provide an adjoining wall structure to the seal that permits unblocked passage of fluid or gas to or from the seal body relief port independent of the rotational orientation of the annular seal in the seal gland. The radial grooves operate to provide a communication path between the circumferential groove and the gap 206 leading to the drill bit external environment to facilitate the passage of fluid or gas therebetween. Together, these seal gland surface features operate to provide for the unrestricted passage of fluid between the seal body relief port and the drill bit external environment.

Figure 19:
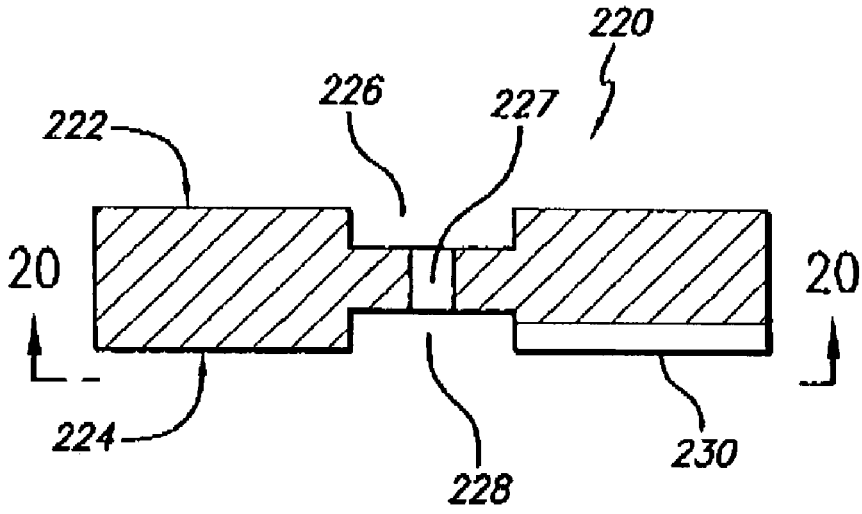
FIG. 19 is a cross-sectional side view of a spacer comprising modified wall surfaces for use with an annular seal of this invention.
Figure 20:
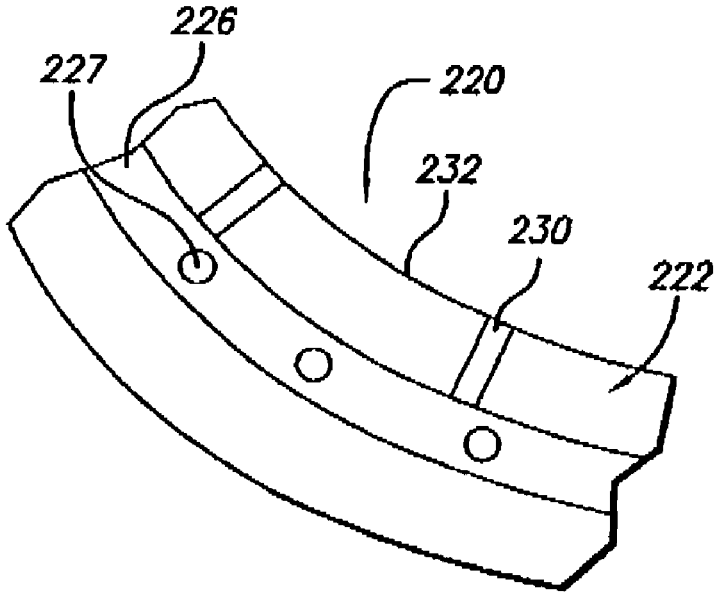
FIG. 20 is a sectional side view of the spacer wall surface of FIG. 19.

Alternatively, referring now to FIGS. 19 and 20, the means for providing unrestricted access to the annular seal relief port can be provided in the form of an annular spacer 220 that is positioned within the drill bit seal gland between the annular seal and the seal gland wall surface. The spacer can be formed from any type of structural material capable of retaining its shape when subjected to seal loading forces and the pressures and temperatures of an operating drill bit. For example, the spacer 220 can be formed from a metallic or non-metallic material.

The spacer 220 includes a seal contact surface 222 on one axial spacer side and a gland wall contact surface 224 on an opposite axial spacer side. A first circumferential groove 226 is disposed a desired depth along the spacer seal contact surface and is positioned to communicate with an opening of the annular seal relief port independent of seal rotational orientation within the seal gland. The spacer 220 includes one or more passages 227 extending axially through a width of the spacer that facilitate passage of fluid or gas from one axial surface of the spacer to an opposite axial surface.

The spacer 220 includes a second circumferential groove 228 that is disposed a depth along the spacer seal gland contact surface, and is positioned on the spacer body generally opposed to the first circumferential groove 226. The spacer further includes one or more radial grooves 230 that are each disposed a depth below the seal gland wall contact surface 224, and that extend radially from the second circumferential groove 228 to a spacer inside diameter edge 232.

Configured in this manner, when placed within a seal gland between the annular seal of this invention and the seal gland wall, the spacer operates to provide an unrestricted communication path for fluid or gas to pass via the seal body from an internal or external environment within the drill bit. Specifically, fluid or gas can pass from the seal relief port outwardly through the spacer via the first circumferential groove 226, through the passages 227, to the second circumferential groove 228, and along the radial grooves 230 to a gap between the drill bit cone and journal that leads to the external environment.

Seal embodiments discussed and illustrated above can be configured to provide for the controlled passage of fluid or gas through the seal body relief port by the selective sizing and configuration of the relief port itself, or by use of a further member disposed within the relief port (as illustrated in FIG. 10). However, in certain applications it may be desired to provide an increased degree of control over the passage of fluid or gas through the seal body. For example, it may be desired in certain applications that the seal operate to provide checked flow of fluid or gas in one direction and not the other. Such one-way checked flow can be used when the annular seal of this invention is the primary seal in a dual-seal drill bit to allow grease to flow into the gap between the seals to keep the gap constantly filled with grease, which will operate to extend the life of the primary seal. It may also be desired to restrict fluid or gas flow in either direction until a certain threshold differential pressure is achieved.

Figure 21:
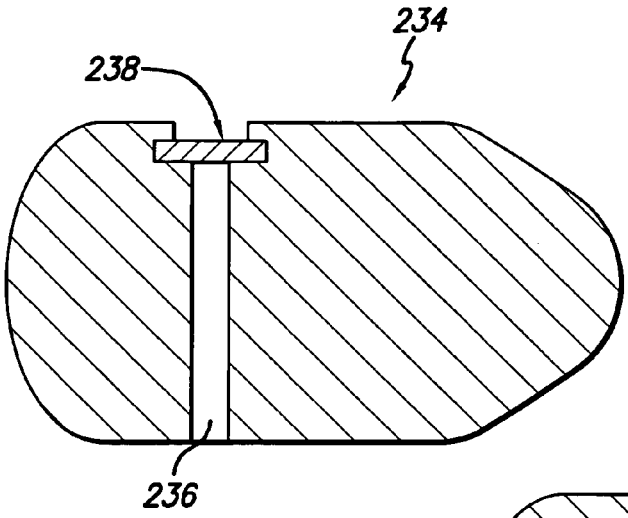
FIG. 21 is a cross-sectional side view of an annular seal constructed according to principles of this invention comprising means for controlling passage of across the relief port.

For such situations, annular seals of this invention can be configured having a separate movable member that is configured to interact with the relief port to provide the function of improved fluid or gas passage control. FIG. 21 illustrates an example seal embodiment 234 of this invention comprising a relief port 236 disposed therethrough, and additionally comprising means 238 for controlling the passage of fluid or gas therethrough until a determined threshold differential pressure is achieved. The means for controlling can be any equivalent structure that will yield upon exposure to a determined differential pressure to permit passage across the relief port.

In an example embodiment, the means for controlling 238 is in the form of a thickness of material that is designed to rupture upon exposure to a determined differential pressure across the relief port opening. Once ruptured, the means can either move clear of the relief port opening to permit unrestricted passage of fluid or gas therethrough, or can be designed to rupture in a manner that still affords a certain degree of control over the passage of fluid or gas therethrough. In this second example, the means for controlling may include a small orifice that itself ruptures and then operates to govern the passage of fluid or gas therethrough when a lower threshold differential pressure is achieved.

Figure 22:
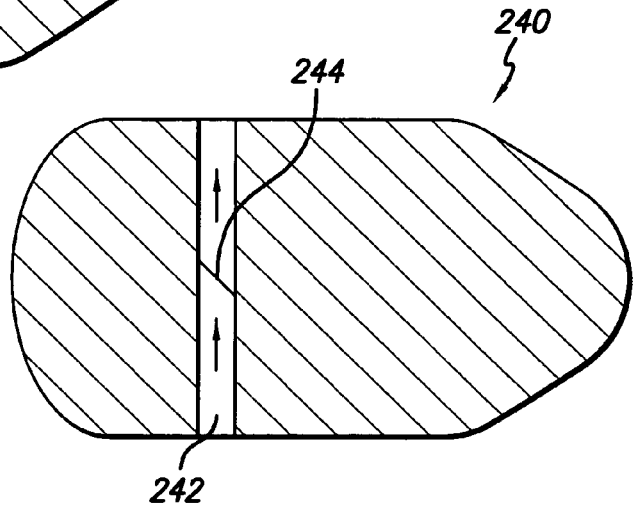
FIGS. 22 to 24 are cross-sectional side views of an annular seals constructed according to principles of this invention comprising a means for providing checked one-way flow through the relief port.

FIG. 22 illustrates another example seal embodiment 240 including a relief port 242 disposed therethrough, and further including means 244 for providing a checked one-way flow of fluid or gas through the relief port. The means for providing checked one-way flow can be provided having a number of different configurations akin to valve mechanisms. In this particular embodiment, the means 244 for providing checked one-way flow is in the form of a flap disposed within the relief port in a manner that is biased to open to facilitate passage in one direction and close to prevent passage in an opposite direction.

Figure 23:
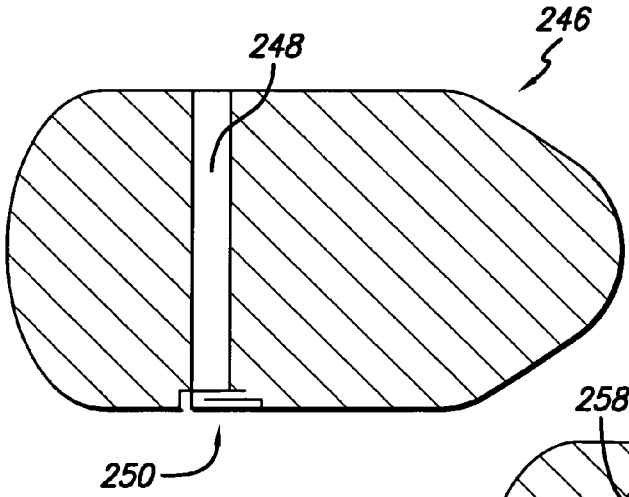

FIG. 23 illustrates an alternative seal embodiment 246 having a flapper-type passage control mechanism to provide checked one-way flow across the relief port 248. In this particular embodiment, a flapper element 250 is positioned at an opening of the relief port rather than within the relief port as with the embodiment illustrated in FIG. 22.

Figure 24:
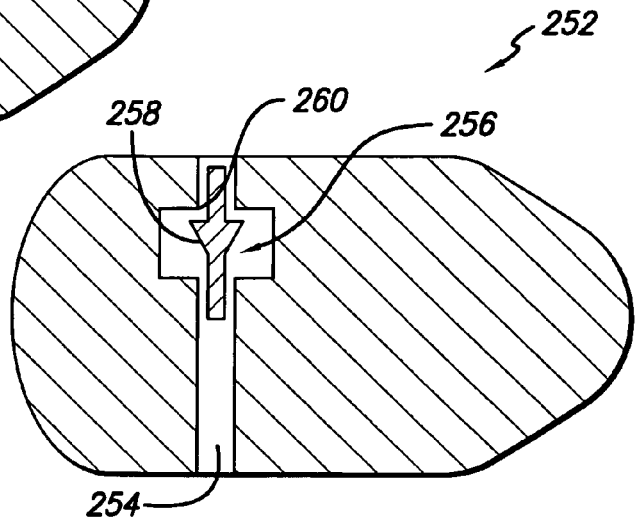

FIG. 24 illustrates still another example seal embodiment 252 of this invention comprising a relief port 254 and comprising means 256 for providing checked one-way flow of fluid or gas therethrough. In this particular embodiment, such means 256 is in the form of a moving element 258 that is disposed within the relief port and that is configured to cooperate with section 260 of the relief port in a manner permitting flow in one direction but not in an opposite direction. In this example, the moving element is in the form of a poppet 258 that is sized and shaped to cooperate with a seat 260 formed in the relief port so that when fluid or gas enters the relief port in one direction it causes the poppet to become sealed against the seat to prevent flow, and when fluid or gas enters the relief port in an opposite direction it causes the poppet to become unsealed from the seat to permit flow.

The particular valve mechanisms discussed above and illustrated in FIGS. 22 to 24 are only but a few examples of the different types of valving arrangements that can be used in with annular seals of this invention to provide an improved degree of control over fluid or gas passage therethrough. It is to be understood that other types of valve mechanisms, commonly used to provide flow control, can be used in association with this invention and, thus are intended to be within the scope of this invention. Examples of such other types of valve mechanisms are slide valves, spool valves, ball valves or the like.

Annular seals of this invention, configured in the above-described and illustrated manner, are useful in such applications as dual-seal bits for reducing built up pressure between the seal rings, and thereby equalizing pressure therebetween. The particular embodiments presented herein are provided for the purpose of reference, and are intended to be representative of some but not all annular seals that can embody the principles of this invention.

What is claimed is:

1. An annular seal for use in a rotary cone drill bit having a body, a leg extending from the body, and a cutting cone rotatably mounted on the leg, the annular seal comprising:

an elastomeric seal body having a first sealing surface that is positioned against an adjacent sealing surface of the leg, and a second sealing surface that is positioned against an adjacent sealing surface of the cone, wherein one of the first and second sealing surfaces forms a dynamic rotary seal against its respective leg or cone sealing surfaces, the seal including a pair of external surfaces each extending along the seal body between the first and second sealing surfaces; and one or more relief ports disposed axially through the seal body and having openings through each of the seal body external surfaces;

wherein the seal is disposed within a gland in the drill bit formed by opposed wall surfaces of the cone, and wherein the seal is positioned within the gland with its external surfaces adjacent a respective wall surface.

2. The annular seal as recited in claim 1 wherein the relief port comprises two or more different diameter sections.

3. The annular seal as recited in claim 1 wherein the relief port comprises a first diameter section that extends into the seal body a distance from one seal body external surface, and a second diameter section that extends from the first diameter section to the other seal body external surface and that is greater in diameter than the first diameter section.

4. The annular seal as recited in claim 3 wherein the first diameter section has a constant diameter, and the second diameter section has a variable diameter.

5. The annular seal as recited in claim 1 wherein the seal body includes a tubular element that is at least partially disposed within the relief port, the tubular element having a central passage extending therethrough.

6. The annular seal as recited in claim 5 wherein the tubular element is formed from a rigid material for reinforcing the relief port.

7. The annular seal as recited in claim 1 wherein the seal body is a one-piece construction and consists essentially of an elastomeric material extending between the pair of external surfaces.

8. The annular seal as recited in claim 1 wherein the relief port includes an element disposed therein for providing a fluid transport conduit within the relief port.

9. The annular seal as recited in claim 8 wherein the seal body includes a surface feature adjacent each relief port opening that increases the surface area of each relief port opening at the external surfaces.

10. The annular seal as recited in claim 1 further comprising an element disposed within the relief port for forming an annular space within the seal body.

11. The annular seal as recited in claim 10 wherein the element disposed within the relief port is formed from a flexible material.

12. The annular seal as recited in claim 10 wherein the element disposed within the relief port is formed from a rigid material.

13. The annular seal as recited in claim 1 further comprising a porous element connected with the seal body and in connection with the relief port.

14. The annular seal as recited in claim 1 wherein the seal body includes a raised surface feature positioned along at least one of the external surfaces adjacent the relief port opening to distance the opening from the adjacent wall surface.

15. The annular seal as recited in claim 1 further comprising a valve means disposed within the relief port to provide checked one-way flow therethrough.

16. A rotary cone drill bit comprising:

a body having at least one leg extending therefrom;

cutting cones rotatably disposed on an end of the leg; and one or more annular seals interposed between the cutting cone and leg and disposed within one or more respective seal glands, at least one seal comprising:

a seal body having a first sealing surface and a second sealing surface for contacting respective drill bit sealing surfaces, and a pair of external surfaces each extending along the seal body between the first and second sealing surfaces, the seal body formed from an elastomeric material extending between the external surfaces and having a one-piece construction; and one or more relief ports disposed axially through the seal body and having openings through each of the seal body external surfaces;

wherein the seal gland is formed by the cone between opposed cone wall surfaces, and the seal is disposed within the seal gland with its pair of external surfaces positioned adjacent a respective cone wall surface.

17. The drill bit as recited in claim 16 wherein the seal gland includes means for facilitating pressure communication with the seal body relief port.

18. The drill bit as recited in claim 17 wherein the means include:

a first groove disposed within a wall surface of the seal gland and extending circumferentially along the wall surface; and one or more second grooves disposed within the seal gland wall surface and extending radially from the first groove to a position adjacent an edge of the seal gland.

19. The drill bit as recited in claim 16 wherein the relief port comprises two or more different diameter sections.

20. The drill bit as recited in claim 19 wherein the relief port comprises a first diameter section that extends into the seal body a distance from one seal body external surface, and a second diameter section that extends from the first diameter section to the other seal body external surface.

21. The drill bit as recited in claim 20 wherein the second diameter section is larger than the first diameter section.

22. The drill bit as recited in claim 20 wherein the second diameter section has a variable diameter and the first diameter section has a constant diameter.

23. The drill bit as recited in claim 16 wherein the seal body includes a tubular element that is at least partially disposed within the relief port.

24. The drill bit as recited in claim 23 wherein the tubular element is formed from a rigid material for reinforcing the relief port.

25. The drill bit as recited in claim 23 wherein the tubular element is formed from a flexible material having a low coefficient of friction.

26. The drill bit as recited in claim 16 wherein the relief port includes an element disposed therein for providing a fluid transport conduit within the relief port.

27. The drill bit as recited in claim 26 wherein the seal body includes a surface feature adjacent each relief port opening that increases the surface area of each relief port opening at the external surfaces.

28. The drill bit as recited in claim 16 further comprising an element disposed within the relief port for forming an annular space within the seal body.

29. The drill bit as recited in claim 28 wherein the element disposed within the relief port is formed from a flexible material.

30. The drill bit as recited in claim 28 wherein the element disposed within the relief port is formed from a rigid material.

31. The drill bit as recited in claim 16 further comprising a porous element connected with the seal body and in communication with the relief port.

32. The drill bit as recited in claim 16 wherein the seal body includes a raised surface feature positioned along at least one of the external surfaces adjacent the relief port opening to distance the opening from being sealed against an adjacent cone wall surface.

33. The drill bit as recited in claim 16 further comprising a valve means disposed within the relief port to provide checked one-way flow therethrough.

34. The drill bit as recited in claim 16 comprising two annular seals, wherein a first seal is positioned within the bit adjacent a journal bearing of the drill bit, and a second seal is positioned within the bit between the first seal and a bit external environment, wherein the second seal includes the one or more relief ports.

35. A rotary cone drill bit comprising:

a body having at least one leg extending therefrom, the leg having a journal segment;

a cutting cone rotatably disposed on the journal segment and forming a bearing cavity therebetween, an annular primary seal disposed between the leg and roller cone;

an annular secondary seal disposed between the leg and roller cone, and positioned between the annular primary seal and a borehole, at least one of the seals comprising:

an elastomeric seal body having a first sealing surface and a second sealing surface for contacting respective drill bit sealing surfaces, and a pair external surfaces each extending along the seal body between the first and second sealing surfaces; and one or more relief ports disposed axially through the seal body and having openings through each of the seal body external surfaces;

wherein the at least one seal is disposed in a gland formed by opposed wall surfaces of the cone, the seal external surfaces being positioned adjacent respective wall surfaces.

36. The drill bit as recited in claim 35 wherein the at least one seal is the annular primary seal.

37. The drill bit as recited in claim 36 wherein the relief port comprises a first diameter section that extends into the seal body a distance from one seal body external surface, and a second diameter section that extends from the first diameter section to the other seal body external surface.

38. The drill bit as recited in claim 37 wherein the second diameter section is larger than the first diameter section.

39. The drill bit as recited in claim 37 wherein the second diameter section has a variable diameter and the first diameter section has a constant diameter.

40. The drill bit as recited in claim 35 wherein the at least one seal is the annular secondary seal.

41. The drill bit as recited in claim 35 further comprising means for facilitating pressure communication with the seal body relief port.

42. The drill bit as recited in claim 38 wherein the means include:

a first groove disposed within the cone wall surface and extending circumferentially therealong; and one or more second grooves disposed within the wall surface and extending radially from the first groove to a position adjacent an edge of the wall surface.

43. The drill bit as recited in claim 35 wherein the relief port comprises two or more different diameter sections.

44. The drill bit as recited in claim 35 wherein the seal body includes a tubular element that is at least partially disposed within the relief port.

45. The drill bit as recited in claim 44 wherein the tubular element is formed from a rigid material for reinforcing the relief port.

46. The drill bit as recited in claim 35 wherein the seal body has a one-piece construction and consists essentially of an elastomeric material extending between the pair of external surfaces.

47. The drill bit as recited in claim 35 wherein the relief port includes an element disposed therein for providing a fluid transport conduit within the relief port.

48. The drill bit as recited in claim 47 wherein the seal body includes a surface feature adjacent each relief port opening that increases the surface area of each relief port opening at the external surfaces.

49. The drill bit as recited in claim 35 further comprising an element disposed within the relief port for forming an annular space within the seal body.

50. The drill bit as recited in claim 49 wherein the element disposed within the relief port is formed from a flexible material.

51. The drill bit as recited in claim 49 wherein the element disposed within the relief port is formed from a rigid material.

52. The drill bit as recited in claim 35 further comprising a porous element connected with the seal body and in communication with the relief port.

53. The drill bit as recited in claim 35 wherein the seal body includes a raised surface feature positioned along at least one of the external surfaces adjacent the relief port opening to distance the opening from being sealed against an adjacent cone wall surface.

54. The drill bit as recited in claim 35 further comprising a valve means disposed within the relief port to provide checked one-way flow therethrough.

55. A method for equalizing differential pressure imposed on an annular seal disposed within a rotary cone drill bit comprising the step of passing fluid or gas from a region of high pressure existing on one side of the seal to a region of relatively lower pressure existing on another side of the seal, through a relief port formed through an elastomeric body of the seal, wherein the relief port extends axially between external surfaces of the seal body, the seal body external surfaces existing between a seal body first sealing surface and a second sealing surface, wherein one of the seal body first and second sealing surfaces is positioned against a surface of a rotary cone, and the other of the seal body first and second sealing surfaces is positioned against a surface of a journal that projects outwardly from a leg extending from a drill bit body, wherein the cone is rotatably mounted on the journal.

56. The method as recited in claim 55 further comprising controlling the passage of fluid or gas through the relief port until a desired threshold is achieved.

* * * * *